US011701539B2

(12) United States Patent
Jaquish et al.

(10) Patent No.: US 11,701,539 B2
(45) Date of Patent: Jul. 18, 2023

(54) VARIABLE RESISTANCE EXERCISE DEVICES

(71) Applicant: Jaquish Biomedical Corporation, Nevada City, CA (US)

(72) Inventors: John Paul Jaquish, Nevada City, CA (US); Paul Edward Jaquish, Nevada City, CA (US); Henry David Alkire, Nevada City, CA (US)

(73) Assignee: Jaquish Biomedical Corporation, Nevada City, CA (US)

( * ) Notice: Subject to any disclaimer, the term of this patent is extended or adjusted under 35 U.S.C. 154(b) by 0 days.

(21) Appl. No.: 16/283,419

(22) Filed: Feb. 22, 2019

(65) Prior Publication Data

US 2020/0269080 A1 Aug. 27, 2020

(51) Int. Cl.
*A63B 21/04* (2006.01)
*A63B 21/02* (2006.01)
(Continued)

(52) U.S. Cl.
CPC .... *A63B 21/0428* (2013.01); *A63B 21/00061* (2013.01); *A63B 21/00065* (2013.01);
(Continued)

(58) Field of Classification Search
CPC ..... A63B 21/075; A63B 21/06; A63B 21/072; A63B 21/0728; A63B 21/0724;
(Continued)

(56) References Cited

U.S. PATENT DOCUMENTS 1,019,861 A * 3/1912 Titus ..... A63B 23/12 482/123
1,997,139 A * 4/1935 Gardener ..... A63B 22/20 36/114

(Continued)

FOREIGN PATENT DOCUMENTS

DE 20 2008 00763 U1 3/2008

OTHER PUBLICATIONS

STIC search report (Year: 2023).*

(Continued)

*Primary Examiner* — Megan Anderson
*Assistant Examiner* — Thao N Do
(74) *Attorney, Agent, or Firm* — Morgan, Lewis & Bockius LLP

(57) ABSTRACT

A variable resistance exercise device is provided that comprises a pair of arm bands and a handle tube that has a longitudinal interior bore. The tube has first and second ends and includes a solid metal center shaft fitted through the interior bore thereby exposing respective first and second end portions of the shaft at the respective first and second ends of the tube. The first and second band arm of the pair of bands arms are respectively fitted onto the first and second ends of the shaft. In some instances, the device is part of a kit that includes a base having a bottom face, where the bottom face includes a groove, and one or more elastic bands, each such band configured to removably couple the base to the exercise bar by fitting the into the groove of the base and through the first and second arm bands.

20 Claims, 6 Drawing Sheets

(51) Int. Cl.
*A63B 23/12* (2006.01)
*A63B 21/00* (2006.01)
*A63B 21/055* (2006.01)

(52) U.S. Cl.
CPC ..... *A63B 21/028* (2013.01); *A63B 21/0557* (2013.01); *A63B 21/4035* (2015.10); *A63B 23/1281* (2013.01); *A63B 2208/0204* (2013.01); *A63B 2209/00* (2013.01)

(58) Field of Classification Search
CPC ..... A63B 21/0428; A63B 21/028; A63B 21/0557; A63B 23/1281; A63B 2209/00; A63B 2209/02; A63B 21/04; A63B 21/07; A63B 21/0414; A63B 21/0421; A63B 21/0435; A63B 21/0442; A63B 21/045; A63B 21/0455; A63B 21/055; A63B 21/0552; A63B 21/0555; A63B 1/00; A63B 3/00
USPC ..... 482/106, 121
See application file for complete search history.

(56) References Cited

U.S. PATENT DOCUMENTS 2,470,815 A * 5/1949 Roosevelt ..... A63B 21/075 482/106
2,637,555 A * 5/1953 Klaudt ..... A63B 1/00 482/40
3,117,781 A 1/1964 Vargo
3,193,288 A 7/1965 De Spain
3,215,429 A * 11/1965 Shaboo ..... A63B 21/4007 482/125
3,256,015 A * 6/1966 Perrin ..... A63B 21/04 482/121
3,785,644 A 1/1974 Bradley
3,910,573 A 10/1975 Jamba
4,200,281 A 4/1980 Wang
4,257,592 A 3/1981 Jones
4,441,707 A 4/1984 Bosch
D274,829 S * 7/1984 Bankier ..... D21/679
4,518,162 A * 5/1985 Oates ..... A63B 21/072 403/349
4,770,414 A * 9/1988 Fredrickson ..... A63B 23/0227 482/148
4,893,810 A * 1/1990 Lee ..... A63B 21/0728 24/115 L
5,112,287 A * 5/1992 Brewer ..... A63B 21/04 482/133
5,125,649 A * 6/1992 Fuller ..... A63B 23/1209 482/106
5,178,596 A 1/1993 McIntire
5,197,934 A 3/1993 Wirtz
D353,419 S 12/1994 Sprague
5,514,058 A 5/1996 Buoni
5,540,642 A 7/1996 Sprague
5,645,511 A 7/1997 Le Roux
5,653,665 A 8/1997 Neeley
5,746,687 A 5/1998 Vial
5,776,041 A 7/1998 Fisher
5,830,110 A 11/1998 Fielding
5,885,196 A 3/1999 Gvoich
5,904,640 A * 5/1999 Shahinian ..... A63B 21/0004 482/110
6,203,476 B1 3/2001 Wang et al.
6,280,366 B1 8/2001 Hsieh
D474,818 S 5/2003 Yu
D482,748 S 11/2003 Flynt
7,052,449 B2 5/2006 Chen
D526,367 S * 8/2006 Loccarini ..... D21/679
7,090,627 B1 * 8/2006 Walker ..... A63B 21/4015 482/121
7,175,574 B2 2/2007 Carmel et al.
7,387,599 B1 * 6/2008 Hsu ..... A63B 21/0552 601/118
7,465,259 B2 12/2008 Mok
D590,457 S 4/2009 Mishan
7,578,775 B2 8/2009 Terry
7,601,101 B2 10/2009 Jackson
D604,374 S 11/2009 Bizzell
D633,155 S 2/2011 Brun
7,892,158 B2 * 2/2011 Varga ..... A63B 21/4017 482/141
7,922,624 B1 4/2011 Fairhurst
8,025,615 B1 * 9/2011 Sargent ..... A63B 22/203 482/50
8,033,964 B1 * 10/2011 Chen ..... A63B 21/00069 482/106
D655,356 S 3/2012 Sandman
8,142,335 B1 * 3/2012 Leach ..... A63B 71/0036 482/49
D682,374 S 5/2013 Wilkinson
D724,163 S 3/2015 Kelley
D739,481 S 9/2015 Glickfield
9,180,335 B1 * 11/2015 Wu ..... A63B 23/0211
D748,745 S * 2/2016 Hansen ..... D21/679
9,254,405 B1 * 2/2016 Marji ..... A63B 21/0552
D778,374 S * 2/2017 Jaquish ..... D21/686
9,675,837 B2 * 6/2017 Smith ..... A63B 21/02
9,724,553 B2 * 8/2017 Kaye ..... A63B 21/00069
D798,396 S 9/2017 Agate
D802,153 S 11/2017 Kelly
9,844,696 B2 * 12/2017 Anderson ..... A43B 3/00
9,907,993 B2 * 3/2018 Penney ..... A63B 21/4035
9,919,176 B2 3/2018 Christie et al.
9,925,410 B2 * 3/2018 Duffy ..... A63B 21/068
D842,940 S 3/2019 Harden
D849,857 S 5/2019 Tartell
D854,635 S 7/2019 Dunahay
D865,084 S 10/2019 Croxton
D895,033 S * 9/2020 Jaquish ..... D21/673
D895,739 S * 9/2020 Jaquish ..... D21/673
D898,132 S * 10/2020 Jaquish ..... D21/673
D898,133 S * 10/2020 Jaquish ..... D21/673
D902,329 S * 11/2020 Jaquish ..... D21/673
D902,330 S * 11/2020 Jaquish ..... D21/673
D902,834 S 11/2020 Kern
D910,124 S * 2/2021 Jaquish ..... D21/673
D937,369 S * 11/2021 Jaquish ..... D21/679
D954,858 S * 6/2022 Karvandi ..... D21/673
11,383,120 B2 * 7/2022 Cone ..... A63B 21/0555
2002/0123416 A1 * 9/2002 Huang ..... A63B 22/20 482/140
2002/0137609 A1 9/2002 Rosati
2002/0198081 A1 * 12/2002 Chen ..... A63B 23/03525 482/23
2003/0096680 A1 * 5/2003 Nethery ..... A63B 23/03516 482/92
2005/0011323 A1 5/2005 Dovner et al.
2005/0113218 A1 * 5/2005 Sewitch, Jr. ..... A63B 15/00 482/99
2005/0113221 A1 * 5/2005 Dovner ..... A63B 21/0552 482/121
2005/0113222 A1 * 5/2005 Dovner ..... A63B 21/00043 482/121
2005/0233877 A1 * 10/2005 Lin ..... A63B 21/026 482/121
2005/0239617 A1 * 10/2005 Tenaglia ..... A63B 21/0552 482/904
2005/0245370 A1 * 11/2005 Boland ..... A63B 23/0458 482/121
2006/0019806 A1 * 1/2006 Mikulski ..... A63B 23/03541 482/121
2006/0276314 A1 * 12/2006 Wilson ..... A63B 21/015 482/106
2007/0197352 A1 * 8/2007 Charniga ..... A63B 21/06 482/93
2007/0207905 A1 9/2007 Winston
2008/0081747 A1 * 4/2008 Mok ..... A63B 21/0552 482/121

(56) References Cited

U.S. PATENT DOCUMENTS

2008/0242438 A1* 10/2008 Sato ..... A63B 53/047 72/370.14
2009/0192022 A1* 7/2009 Kulka ..... A63B 21/153 482/46
2010/0152002 A1* 6/2010 Knight ..... A63B 21/072 482/121
2010/0173760 A1* 7/2010 Hall ..... A63B 21/0552 482/129
2010/0317496 A1* 12/2010 Abranchess ..... A63B 23/12 482/141
2010/0319814 A1 12/2010 Perez et al.
2011/0251033 A1* 10/2011 Blancher ..... A63B 22/16 482/123
2012/0094812 A1* 4/2012 Smiley ..... A63B 21/05 482/128
2012/0225758 A1* 9/2012 Shaw ..... A63B 21/0004 482/110
2013/0310233 A1* 11/2013 Dahlquist ..... A63B 21/4025 482/139
2014/0087927 A1* 3/2014 Richard ..... A63B 23/0458 482/123
2014/0155232 A1* 6/2014 Wolan ..... A63B 21/0442 482/123
2014/0287889 A1* 9/2014 Grace ..... A63B 21/0783 482/106
2014/0302968 A1* 10/2014 Velikin ..... A63G 9/12 482/40
2014/0336019 A1 11/2014 Villella
2014/0349821 A1* 11/2014 Davis ..... A63B 21/0555 482/122
2015/0126342 A1* 5/2015 Kaye ..... A63B 23/1209 482/121
2015/0190679 A1* 7/2015 Carbone ..... A63B 21/00069 482/146
2016/0038781 A1* 2/2016 Christie ..... A63B 21/00061 482/121
2016/0144217 A1* 5/2016 Oltorik, Jr. ..... A63B 21/4043 482/130
2016/0144221 A1* 5/2016 Wallander ..... A63B 21/4035 482/106
2016/0287929 A1* 10/2016 Poole ..... A63B 21/0552
2017/0188649 A1* 7/2017 Allen ..... A42B 3/064
2017/0209730 A1* 7/2017 Sise ..... A63B 23/03525
2017/0216650 A1* 8/2017 Simmons ..... A63B 21/4045
2017/0266486 A1 9/2017 Anderson
2017/0274239 A1* 9/2017 Barella ..... A63B 23/03525
2018/0036580 A1* 2/2018 Hao ..... A63B 23/12
2018/0104538 A1* 4/2018 Uygan ..... A63B 21/0414
2018/0161619 A1* 6/2018 Rossi ..... A63B 21/4035
2018/0236295 A1* 8/2018 Oltorik ..... A63B 21/4013
2018/0236299 A1* 8/2018 Warriner ..... A63B 21/4035
2018/0326245 A1* 11/2018 Davis ..... A63B 26/003
2019/0329084 A1* 10/2019 Stewart ..... A63B 21/4035
2020/0054917 A1* 2/2020 Lin ..... A63B 21/0407

OTHER PUBLICATIONS

X3 Bar Review—Portable, Heavy-Resistance Band Training on the road or at home—Youtube (https://www.youtube.com/watch?v=ikYqDtFxPfc) (Year: 2018).*
Google search (Year: 2023).*
Youtube search (Year: 2023).*
Facebook search (Year: 2023).*
GoFit bar, announced 2016 [online], [site visited May 3, 2021]. Available on internet:https://www.amazon.com/Go Fit-RAB-Resistance-Traini ng-Bar/dp/B01MTM7 N 97/ref=sr 131?dchild=l &keywords=exercise+bar+with+hook&qid=1619657583&s=sporting-goods&sr=1-31 (Year: 2016).

* cited by examiner

VARIABLE RESISTANCE EXERCISE DEVICES

FIELD

The present disclosure relates generally to exercise apparatuses. More particularly, the present disclosure pertains to an improved handle for exercise apparatuses.

BACKGROUND

Variable resistance exercise devices have been identified as being advantageous relative to conventional exercise devices on the basis that variable resistance device offer variable, but persistent, resistance across a range of motion whereas conventional exercise devices, such as free weights, offer constant resistance. Constant resistant devices have the drawback that they force a user to exert the same amount both at the beginning of a range of motion (e.g., short exertion distance) before advantageous body mechanics arise and at the end of the range of motion where the user enjoys better body mechanics and can exert more force. As such, with conventional weights it is often the case that the user cannot exercise muscles across a full range of motion with sufficient resistance because the user cannot move past the initial ranges of motion where the user is weakest. Variable resistance exercise devices address this problem by providing low resistance at the beginning of the range of motion and higher resistance at the end of the range of motion.

However, existing variable resistance exercise devices have their drawbacks. While they offer a tremendous amount of resistance at the end of a range of motion, which is advantageous, such large resistance requires that the device be very stable and well-engineered to provide the stability needed by an exerciser that is fully concentrating on the large resistances that occur at the far end of the range of motion of exercises that are performed with such devices. Numerous designs for variable resistance devices have been build and sold over the years. However, advances in the design of such devices are needed in order to increase their utility, the breadth of exercises that they can be used for, and the maximum amount of resistance that they can safely tolerate.

Given the above disclosure, what is needed in the art are improved variable resistance exercise devices.

SUMMARY

The present disclosure addresses the above-identified shortcomings by providing improved variable resistance exercise devices. The improved variable resistance exercise devices are more stable than the above-identified prior art variable resistance exercise devices while at the same time offering the same advantages over conventional constant resistance exercise devices such as free weights.

In accordance with some embodiments, an exercise bar with an improved handle is provided. The exercise bar includes a handle tube that has a longitudinal interior bore. The handle tube also includes a first end and a second end. Further, the handle tube includes a solid metal center shaft that is fitted through the longitudinal interior bore. This fitting of the solid metal center shaft through the longitudinal interior bore exposes a first end portion of the solid metal center shaft at the first end of the handle tube. The fitting of the metal center shaft through the longitudinal interior bore also exposes a second end portion of the solid metal center shaft at the second end of the handle tube. A first band arm is fitted onto the first end of the solid metal center shaft, and a second band arm fitted onto the second end of the solid metal center shaft.

In some embodiments, the exercise bar includes a first cylindrical handle end cap that has a first end face, a second end face, and a cylindrical exterior face. The first cylindrical handle end cap also includes a first bore hole that is disposed along a central axis of the first cylindrical handle end cap between the first and second face of the first handle end cap. The exercise bar also includes a second cylindrical handle end cap that has a first end face, a second end face, and a cylindrical exterior face. The second cylindrical handle end cap also includes a first bore hole along a central axis of the second cylindrical handle end cap between the first and second face of the second cylindrical handle end cap. Accordingly, the first end portion of the solid metal center shaft is fitted through the first bore hole of the first cylindrical handle end cap, and the second end portion of the solid metal center shaft is fitted through the first bore hole of the second cylindrical handle end cap. Further, the first band arm is fitted onto the first end of the solid metal center shaft through attachment to the first cylindrical handle end cap, and the second band arm is fitted onto the second end of the solid metal center shaft through attachment to the second cylindrical handle end cap.

In some embodiments, the exercise bar includes a first handle bearing and a second handle bearing. Each of the first and the second handle bearings includes a respective hollowed cylindrical piece that includes an inner circumferential surface and an outer circumferential surface. The first end portion of the solid metal center shaft is fitted through the first handle bearing with the outer circumferential surface of the solid metal shaft contacting the inner circumferential surface of the first handle bearing. The second end portion of the solid metal center shaft is fitted through the second handle bearing with the outer circumferential surface of the solid metal shaft contacting the circumferential inner surface of the second handle bearing. Additionally, the longitudinal interior bore of the handle tube encapsulates and makes frictional contact with the outer circumferential surface of both the first and second handle bearings.

In some embodiments, the exercise bar includes a first outer washer that is fitted onto the first end portion of the solid metal shaft. The exercise bar also includes a second outer washer fitted onto the second end portion of the solid metal shaft. Accordingly, a first face of the first outer washer is juxtaposed against an end face of the first hollowed metal cylindrical piece, and a second face, opposed to the first face, of the first outer washer is juxtaposed against a first face of the first cylindrical handle end cap. Likewise, a first face of the second outer washer is juxtaposed against an end face of the second hollowed metal cylindrical piece, and a second face, opposed to the first face, of the second outer washer is juxtaposed against a first face of the second cylindrical handle end cap.

In some embodiments, the first cylindrical handle end cap has a second bore hole, orthogonal to the first bore hole of the first cylindrical handle end cap, where the second bore hole of the first cylindrical handle end cap runs between the cylindrical exterior face of the first cylindrical handle end cap and the central axis of the first cylindrical handle end cap. Likewise, the second cylindrical handle end cap has a second bore hole, orthogonal to the first bore hole, wherein the second bore hole of the second cylindrical handle end cap runs between the cylindrical exterior face of the second cylindrical end cap and the central axis of the second cylindrical handle end cap. The first band arm is attached to the first cylindrical handle end cap by slotting a first end of the first band arm through the second bore hole of the first cylindrical handle end cap. Similarly, the second band arm is attached to the second cylindrical handle end cap by slotting a first end of the second band arm through the second bore hole of the second cylindrical handle end cap. In some such embodiments, the first end portion of the solid metal center shaft includes a first notch that receives the first end of the first band arm. Similarly, the second end portion of the solid metal center shaft includes a second notch that receives the first end of the second band arm.

In some embodiments, the exercise bar includes a first locking pin and a second locking pin. In some such embodiments, the first cylindrical handle end cap includes a third bore hole that runs between the first and second face of the first handle end cap, parallel to the first bore hole of the first cylindrical handle end cap, and passing through the second bore hole of the first handle end cap. Similarly, the second cylindrical handle end cap includes a third bore hole running between the first and second face of the second handle end cap, parallel to the first bore hole of the second cylindrical handle end cap, and passing through the second bore hole of the second handle end cap. Moreover, the first end of the first band arm includes a bore hole and the first end of the second band arm includes a bore hole. Accordingly, the first locking pin locks the first end of the first band arm to the first cylindrical handle end cap by insertion through both the third bore hole of the first cylindrical handle end cap and the bore hole of the first band arm. Likewise, the second locking pin locks the first end of the second band arm to the second cylindrical handle end cap by insertion through both the third bore hole of the second cylindrical handle end cap and the bore hole of the second band arm.

In some embodiments, the handle tube includes a metal material. Further, the handle tube includes a first circumferential grip region and a second circumferential grip region.

In some embodiments, the first band arm includes a metal material. Further, the first band arm includes a hook region that receives a first portion of an elastic band, and the second band arm is includes a metal material and further includes a hook region that receives a second portion of the elastic band.

In some embodiments, the solid metal center shaft is made of steel.

In some embodiments, the present disclosure provides an exercise bar that includes an improved handle. The exercise bar includes a handle tube that has a bore hole through a longitudinal axis thereof, and a first end portion and a second end portion. Further, the handle tube includes a center shaft that is fitted through the bore hole. This fitting of the center shaft exposes a first end portion and a second end portion of the center shaft at the respective end portions of the handle tube. A first band arm is fitted onto the first end portion of the center shaft, and a second band arm is fitted onto the second end portion of the center shaft.

In some embodiments, the present disclosure provides an exercise kit. The exercise kit includes an exercise bar as described herein. The exercise kit also includes a base. Further, the exercise kit includes one or more elastic bands. Accordingly, an elastic band in the one or more elastic bands removably couple the base to the exercise bar.

In some embodiments, the exercise kit includes at least three elastic bands of different resistances to deforming.

BRIEF DESCRIPTION OF THE DRAWINGS

For a better understanding of the disclosed embodiments, reference should be made to the Description of Embodiments below, in conjunction with the following drawings in which like reference numerals refer to corresponding parts throughout the figures.

The implementations disclosed herein are illustrated by way of example, and not by way of limitation, in the figures of the accompanying drawings. Like reference numerals refer to corresponding parts throughout the drawings.

DESCRIPTION OF EMBODIMENTS

Figure 1:
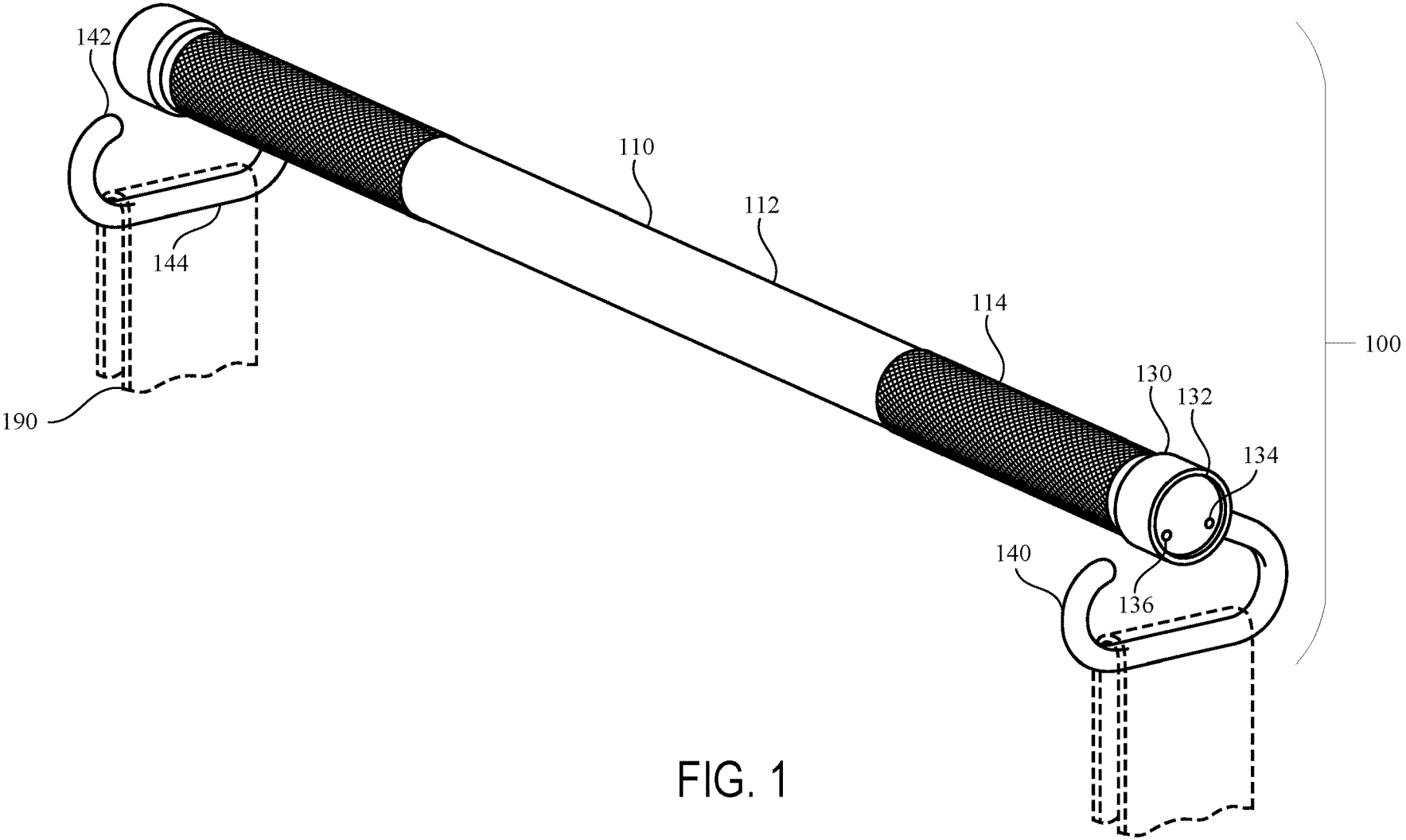
FIG. 1 illustrates an exemplary exercise bar, in accordance with an embodiment of the present disclosure.

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, circuits, and networks have not been described in detail so as not to unnecessarily obscure aspects of the embodiments.

Plural instances may be provided for components, operations or structures described herein as a single instance. Finally, boundaries between various components, operations, and data stores are somewhat arbitrary, and particular operations are illustrated in the context of specific illustrative configurations. Other forms of functionality are envisioned and may fall within the scope of the implementation(s). In general, structures and functionality presented as separate components in the example configurations may be implemented as a combined structure or component. Similarly, structures and functionality presented as a single component may be implemented as separate components. These and other variations, modifications, additions, and improvements fall within the scope of the implementation(s).

It will also be understood that, although the terms "first," "second," etc. may be used herein to describe various elements, these elements should not be limited by these terms. These terms are only used to distinguish one element from another. For example, a first handle could be termed a second handle, and, similarly, a second handle could be termed a first handle, without departing from the scope of the present disclosure. The first handle and the second handle are both handles, but they are not the same handle. Further, the terms "exerciser," "end user," and "user" are interchangeable.

The terminology used herein is for the purpose of describing particular implementations only and is not intended to be limiting of the claims. As used in the description of the implementations and the appended claims, the singular forms "a", "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

For purposes of explanation, numerous specific details are set forth in order to provide an understanding of various implementations of the inventive subject matter. It will be evident, however, to those skilled in the art that implementations of the inventive subject matter may be practiced without these specific details. In general, well-known structures and techniques have not been shown in detail.

The foregoing description, for purpose of explanation, has been described with reference to specific implementations. However, the illustrative discussions below are not intended to be exhaustive or to limit the implementations to the precise forms disclosed. Many modifications and variations are possible in view of the above teachings. The implementations are chosen and described in order to best explain the principles and their practical applications, to thereby enable others skilled in the art to best utilize the implementations and various implementations with various modifications as are suited to the particular use contemplated.

In the interest of clarity, not all of the routine features of the implementations described herein are shown and described. It will be appreciated that, in the development of any such actual implementation, numerous implementation-specific decisions are made in order to achieve the designer's specific goals, such as compliance with use case- and business-related constraints, and that these specific goals will vary from one implementation to another and from one designer to another. Moreover, it will be appreciated that such a design effort might be complex and time-consuming, but nevertheless be a routine undertaking of engineering for those of ordering skill in the art having the benefit of the present disclosure.

For convenience in explanation and accurate definition in the appended claims, the terms "upper," "lower," "up," "down," "upwards," "downwards," "laterally, "longitudinally," "inner," "outer," "inside," "outside," "inwardly," "outwardly," "interior," "exterior," "front," "rear," "back," "forwards," and "backwards" are used to describe features of the exemplary embodiments with reference to the positions of such features as displayed in the figures.

In general, an exercise bar of the present disclosure enables an end-user to perform a variety of exercises at a multitude of resistance ranges.

Referring to FIGS. 1 through 7, an exercise bar 100 of the present disclosure is illustrated. The exercise bar 100 includes a handle tube 110 that is configured to accommodate hands of an end-user (e.g., end-user 610 of FIGS. 6 and 7).

In some embodiments, the handle tube 110 is about 30 centimeters (cm) in length. In some embodiments, the handle tube 110 is about 35 cm in length. In some embodiments, the handle tube 110 is about 40 cm in length. In some embodiments, the handle tube 110 is about 50 cm in length. In some embodiments, the handle tube 110 is about 53 cm in length. In some embodiments, the handle tube 110 is about 53.34 cm (e.g., about 21 inches) in length. In some embodiments, the handle tube 110 is about 54 cm in length. In some embodiments, the handle tube 110 is about 55 cm in length. In some embodiments, the handle tube 110 is about 60 cm in length. In some embodiments, the handle tube 110 is about 70 cm in length. In some embodiments, the handle tube 110 is about 80 cm in length. In some embodiments, the handle tube 110 is about 90 cm in length. In some embodiments, the handle tube 110 is about 100 cm in length. In some embodiments, the handle tube 110 is about 110 cm in length. In some embodiments, the handle tube 110 is about 120 cm in length. In some embodiments, the handle tube 110 is about 130 cm in length. In some embodiments, the handle tube 110 is about 131 cm in length. In some embodiments, the handle tube 110 is about 140 cm in length. In some embodiments, the handle tube 110 is about 150 cm in length. In some embodiments, the exercise bar 100 is about 160 cm in length. In some embodiments, the handle tube 110 is about 170 cm in length. In some embodiments, the handle tube 110 is about 180 cm in length. In some embodiments, the handle tube 110 is about 190 cm in length. In some embodiments, the handle tube 110 is about 200 cm in length. In some embodiments, the handle tube 110 is about 210 cm in length. In some embodiments, the handle tube 110 is about 220 cm in length (e.g., approximately a length of an Olympic barbell). In some embodiments, the handle tube 110 is between 50 cm and 300 cm in length. In some embodiments, the handle tube 110 is between 100 cm and 250 cm in length. In some embodiments, the handle tube 110 is between 150 cm and 230 cm in length.

Furthermore, in some embodiments a diameter of the handle tube 110 is 2.5 cm. In some embodiments, a diameter of the handle tube 110 is about 2.8 cm. In some embodiments, a diameter of the handle tube 110 is about 5 cm. In some embodiments, a diameter of the handle tube 110 is about 5.1 cm. In some embodiments, a diameter of the handle tube 110 is between 2.5 cm and 5.5 cm. In some embodiments, a diameter of the handle tube 110 is between 3.0 cm and 5.3 cm.

In some embodiments, the handle tube 110 includes one or more circumferential grip region types. For instance, in some embodiments the handle tube includes a first circumferential grip region type 112 and a second circumferential grip region type 114. In some embodiments, the first circumferential grip region type 112 is a level (e.g., smooth) surface while the second circumferential grip region type 114 is characterized by a pattern of straight, angled, and/or crossed lines (e.g., a result of being subjected to knurling). In some embodiments, the handle tube 110 includes a first end portion and a second end portion (e.g., a right hand portion and a left hand portion). Accordingly, in some embodiments the second circumferential grip region type 114 is disposed at both the first end portion and the second end portion of the handle tube 110 while the first circumferential grip region is disposed on the handle tube 110 between the first and second end portions. Utilizing the circumferential grip regions at least improves the grip of an end-user while the user utilizes the exercise bar 100. In some embodiments the first and second end portions occupied by the second circumferential grip region type 114 are each between 10 cm and 30 cm in length. In some embodiments the first and second end portions occupied by the second circumferential grip region type 114 collectively occupy between 35 percent and 65 percent of the total length of the handle tube 110.

In some embodiments, the handle tube 110 includes a metal material such as a metal alloy (e.g., steel, iron, etc.). In some embodiments, the handle tube 110 consists of metal or metal alloy (e.g., steel, iron, etc.). In some embodiments the handle tube includes an austenite steel (e.g., AISI type no. 201, 202, 301, 302, 302B, 303, 303 (Se), 304, 304L, 305, 308, 309, 309S, 310, 310S, 314, 316, 317, 321, 347, or 348, etc.), a martensitic steel (e.g., AISI type no. 403, 410, 414, 416, 416(Se), 420, 420F, 431, 440A, 440B, 440C, or 501, etc.), or a ferritic steel (AISI type no. 405, 429, 430, 430F, 430F(Se), 442, 446, or 502) such as those described in Table 6.2.18a of Marks' *Standard Handbook for Mechanical Engineers*, ninth edition, 1987, McGraw-Hill, Inc., at p. 6-37. In some embodiments, the handle tube 110 includes a nickel alloy (e.g., Nickel 270, Nickel 200, Duranickel 301, Monel 400, Monel K-500, Hastelloy C, Incoloy 825, Inconel 600, Inconel 718, or TD Ni) such as those described in Table 6.4.7 of Marks' *Standard Handbook for Mechanical Engineers*, ninth edition, 1987, McGraw-Hill, Inc., at p. 6.72, which is hereby incorporated by reference. In some embodiments handle tube 110 includes a high-strength low-alloy steel (HSLA). HSLA is a type of alloy steel that provides better mechanical properties or greater resistance to corrosion than carbon steel. In some embodiments the HSLA steel has a carbon content between 0.05-0.25%. In some embodiments the HSLA steel includes up to 2.0% manganese and small quantities of copper, nickel, niobium, nitrogen, vanadium, chromium, molybdenum, titanium, calcium, rare earth elements, or zirconium. For more disclosure on HSLA steel that can be used to make the handle tube 100, see Degarmo et al., 2003, *Materials and Processes in Manufacturing* (9th ed.), Wiley, ISBN 0-471-65653-4, and Oberg et al., 1996, *Machinery's Handbook* (25th ed.), Industrial Press Inc., each of which is hereby incorporated by reference.

Utilizing metal typically increases a load bearing capacity of the exercise bar 100. However, the present disclosure is not limited thereto. For instance, in some embodiments all or a portion of the handle tube 110 is coated with an elastomer (e.g., a rubberized coating). Moreover, in some embodiments the handle tube 110 includes a grip disposed about a circumference thereof (e.g., a foam grip and/or a rubber grip, etc.). In some such embodiments, the handle tube 110 includes one or more circumferential grip region types. For instance, in some embodiments the handle tube includes a first circumferential grip region type 112 and a second circumferential grip region type 114. In some embodiments, the first circumferential grip region type 112 is a level (e.g., smooth) uncoated surface while the second circumferential grip region type 114 is coated with an elastomer or a foam. In some embodiments, the handle tube 110 includes a first end portion and a second end portion (e.g., a right hand portion and a left hand portion). Accordingly, in some such embodiments the second circumferential grip region type 114 is disposed at both the first end portion and the second end portion of the handle tube 110 while the first circumferential grip region is disposed on the handle tube 110 between the first and second end portions. Utilizing the circumferential grip regions at least improves the grip of an end-user while the user utilizes the exercise bar 100. In some embodiments, the second circumferential grip region type 114 is coated with GR-S, neoprene, a nitrile rubber, a butyl rubber, a polysulfide rubber, or an ethylene-propylene rubber (e.g., ethylene propylene diene methylene (EPDM) rubber), a cyclized rubber (e.g., Thermoprene). See for example, Sections 6-161 through 6-163 of Marks' *Standard Handbook for Mechanical Engineers*, ninth edition, 1987, McGraw-Hill, Inc., beginning at p. 6.161, which is hereby incorporated by reference.

Figure 2:
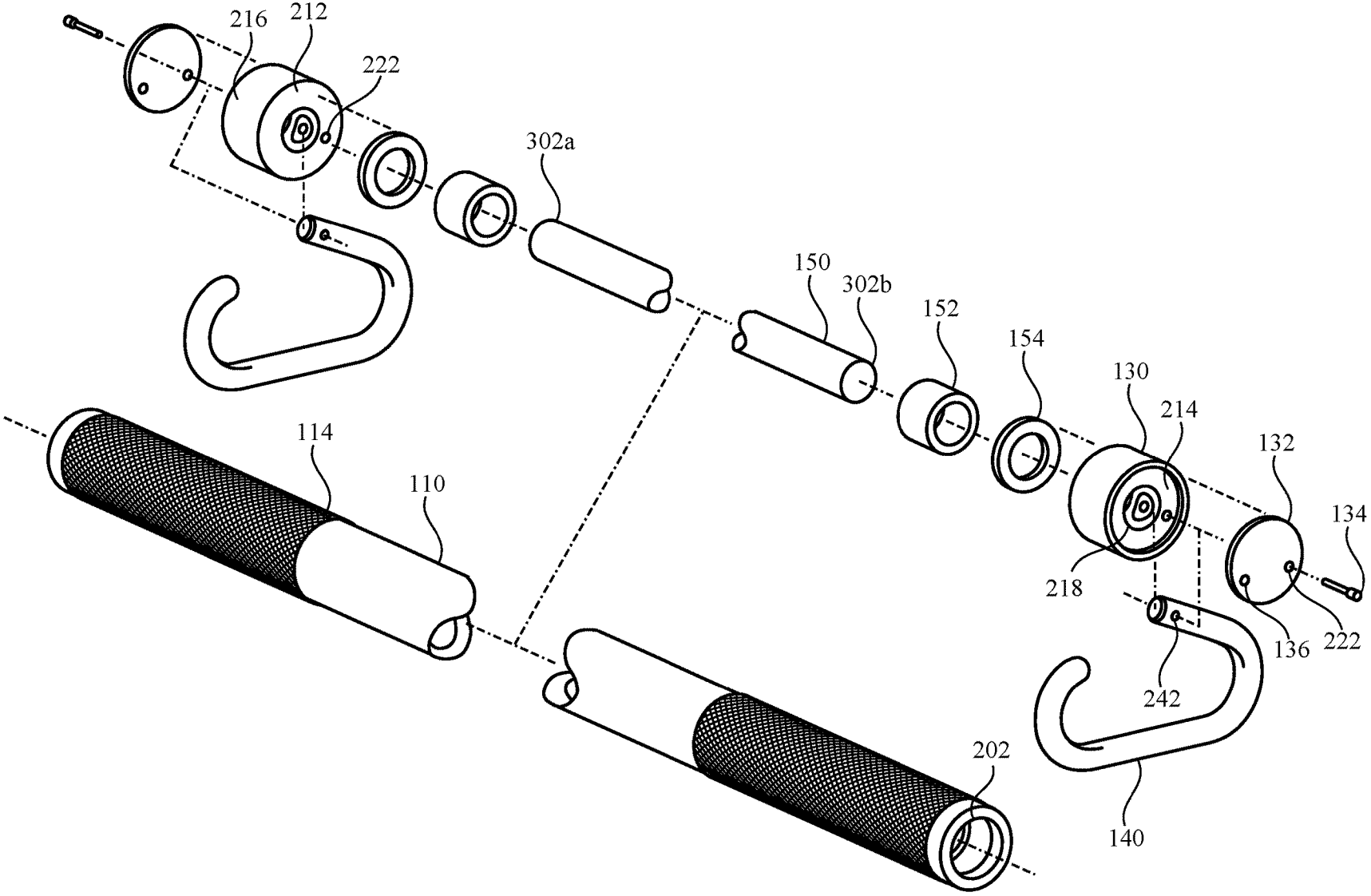
FIG. 2 illustrates an exploded view of an exemplary exercise bar, in accordance with an embodiment of the present disclosure.

In some embodiments, the handle tube 110 includes a longitudinal interior bore (e.g., longitudinal bore 202 of FIG. 2). Further, in some embodiments the handle tube 110 includes a metal center shaft 150 that is fitted through the longitudinal interior bore 202. In some embodiments, the metal center shaft 150 is a solid rod (e.g., a solid metal center shaft). In some embodiments, the metal center shaft 150 is a hollow rod. Moreover, in some embodiments the center shaft 150 includes a metal material (e.g., steel, iron, etc.). In some embodiments, the center shaft 150 includes the same material as the handle tube 110. In some embodiments the center shaft 150 includes a material that is different than the handle tube 110. In some embodiments, the center shaft 150 includes or consists of a metal or metal alloy (e.g., steel, iron, etc.). In some embodiments, the center shaft 150 includes an austenite steel (e.g., AISI type no. 201, 202, 301, 302, 302B, 303, 303 (Se), 304, 304L, 305, 308, 309, 309S, 310, 310S, 314, 316, 317, 321, 347, or 348, etc.), a martensitic steel (e.g., AISI type no. 403, 410, 414, 416, 416(Se), 420, 420F, 431, 440A, 440B, 440C, or 501, etc.), or a ferritic steel (AISI type no. 405, 429, 430, 430F, 430F(Se), 442, 446, 502) such as those described in Table 6.2.18a of Marks' *Standard Handbook for Mechanical Engineers*, ninth edition, 1987, McGraw-Hill, Inc., at p. 6-37. In some embodiments, the center shaft 150 includes a nickel alloy (e.g., Nickel 270, Nickel 200, Duranickel 301, Monel 400, Monel K-500, Hastelloy C, Incoloy 825, Inconel 600, Inconel 718, or TD Ni) such as those described in Table 6.4.7 of Marks' *Standard Handbook for Mechanical Engineers*, ninth edition, 1987, McGraw-Hill, Inc., at p. 6.72, which is hereby incorporated by reference. In some embodiments the center shaft 150 includes a high-strength low-allow steel (HSLA).

In some embodiments the center shaft 150 is fitted through the interior bore 202 such that a circumferential gap (e.g., a cushion of air) is formed between the circumferential exterior surface of the center shaft 150 and the circumferential interior surface of the handle tube 110. The fitting of the center shaft 150 exposes a first end portion of the center shaft 150 at the first end of the handle tube 110. Similarly, the fitting of the center shaft 150 through the longitudinal bore 202 exposes a second end portion of the center shaft at the second end of the handle tube 110. In some embodiments, the first end portion and the second end portion of the center shaft 150 are exposed at a same length (e.g., 1 cm). In some embodiments, the length of the exposure of the first end portion and the second end portion of the center shaft 150 is about a length of a handle end cap (e.g., end cap 130 of FIG. 1). In some embodiments, the center shaft 150 includes one or more tapers. For instance, in some embodiments the center shaft 150 is tapered from a first end portion to a middle portion of the center shaft. In some embodiments, the center shaft 150 is tapered from a second end portion to the middle portion of the center shaft. Tapering of the center shaft 150 allows for various components of the exercise bar 100 (e.g., a bearing 152, a washer 154, etc.) to be securely disposed on the center shaft.

Referring to FIG. 2, in some embodiments a respective band arm 140 is fitted onto a respective end portion of the center shaft 150. For instance, in some embodiments a first band arm 140 is fitted onto the first end of the center shaft 150 and, similarly, a second band arm 140 fitted onto the second end of the center shaft 150. Each respective band arm 140 is configured to accommodate a portion of an elastic band. For instance, in some embodiments the first band arm 140 is configured to accommodate a first portion of a first elastic band (e.g., elastic band 190 of FIG. 1), and the second band arm 140 is configured to accommodate a first portion of a second elastic band 190 (e.g., each respective band arm accommodates a respective elastic band. However, the present disclosure is not limited thereto. For instance, in some embodiments the first band arm 140 accommodates a first portion of an elastic band 190 while the second band arm 140 accommodates a second portion of the elastic band. Additional details and information regarding configurations of one or more elastic bands will be described in more detail infra, with particular reference to at least FIGS. 6 and 7. Moreover, in some embodiments each respective band arm 140 is made of metal (e.g., steel, iron, etc.). In some embodiments, each respective band arm 140 is made of any of the materials disclosed above for the center shaft 150 and/or the handle tube 110.

Additionally, in some embodiments each respective band arm 140 includes a hook region (e.g., region 142 of FIG. 1) that is configured to receive a respective end portion of an elastic band 190. Each hook region 142 provides a gap between the respective band arm 140 and the handle tube 110, allowing an elastic band 190 to be received through the gap by the band arm 140. However, the present disclosure is not limited thereto. For instance, in some embodiments each respective band arm 140 coupled to the handle tube 110 comprises two or more portions. Accordingly, in some embodiments, one or more of the two or more coupling portions is removably coupled to the handle tube 110, allowing for the elastic band 190 to be accommodated by the respective band arm 140.

In the illustrated embodiments, each band arm 140 includes a substantially level portion 144. In some embodiments, the level portion 144 spans a length that is about a width of a corresponding elastic band 190. The level portion 144 allows for a respective elastic band 190 to rest in a state that provides an even distribution of resistance to the corresponding band arm 140 (e.g., the respective band 190 lays flat against the corresponding band arm 140). In some embodiments the band 190 has a width of between 5 centimeters and 30 centimeters, and correspondingly, the level portion 144 is long enough to accommodate the full width of the band 190. In some embodiments the band 190 has a width of between 8 centimeters and 25 centimeters, and correspondingly, the level portion 144 is long enough to accommodate the full width of the band 190.

In some embodiments, the exercise bar 100 includes a corresponding handle end cap 130 for each respective end portion of the handle tube 110 (e.g., a first handle end cap 130 and a second handle end cap 130). Each respective end cap 130 includes a first end face (e.g., an interior face 212 of FIG. 2) and a second end face (e.g., an exterior face 214 of FIG. 2). In some embodiments, each respective handle end cap 130 includes a cylindrical exterior face (e.g., exterior face 216 of FIG. 2).

Figure 3:
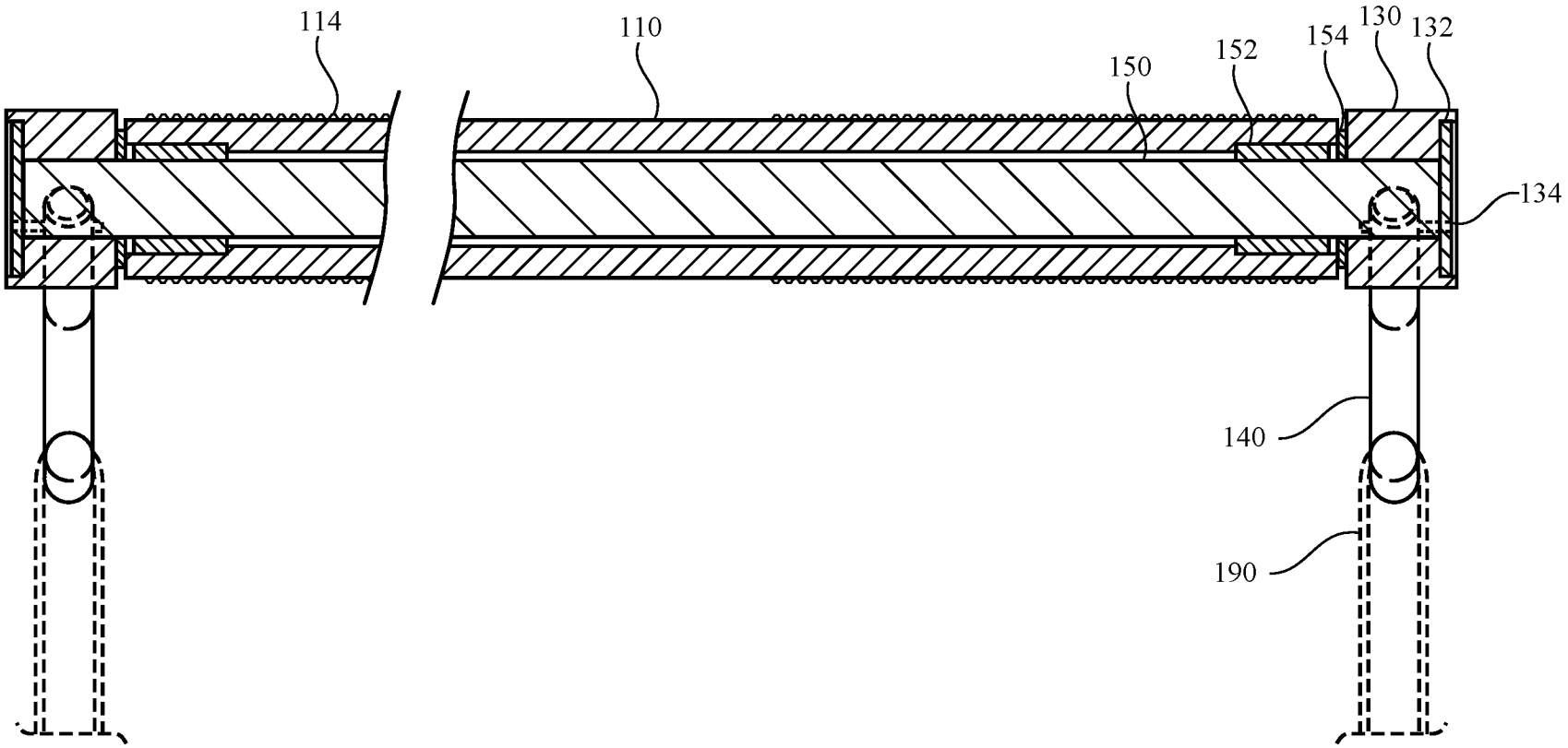
FIG. 3 illustrates a cross sectional view of an exemplary exercise bar, in accordance with an embodiment of the present disclosure.
Figure 5:
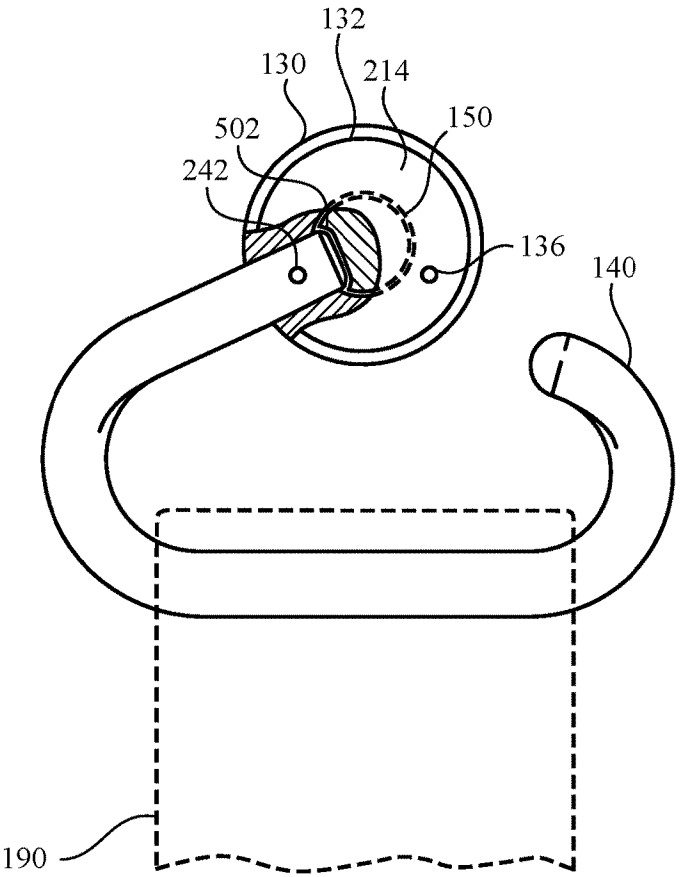
FIGS. 4 and 5 illustrate an exemplary locking mechanism of an end portion of an exercise bar, in accordance with an embodiment of the present disclosure.
Figure 4:
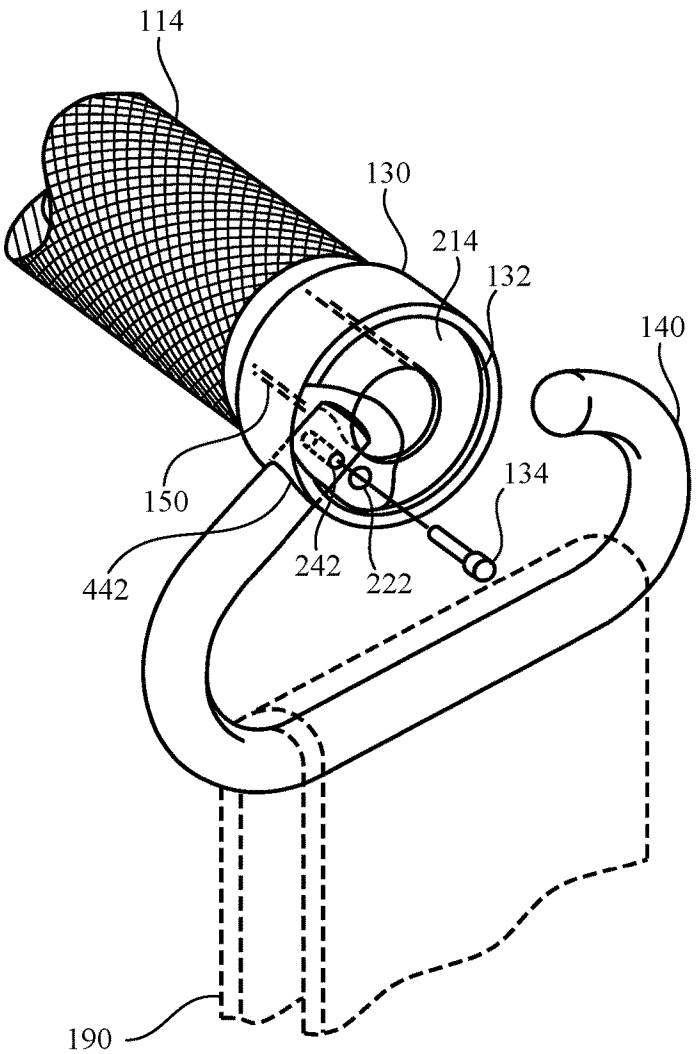

Referring to FIGS. 4 and 5, each respective handle end cap 130 further includes a first bore hole 218 that is disposed along a central axis of the respective handle end cap between the first face 212 and second face 214 of the respective handle end cap. Accordingly, referring to FIG. 3, first and second respective end portions 302 of the center shaft 150 are fitted through the respective first bore hole of corresponding handle end caps 130 (e.g., the first end portion 302*a* of the center shaft 150 is fitted through the first handle end cap 130 and the second end portion 302*b* of the center shaft is fitted through the second handle end cap 130).

In some embodiments, the exercise bar 100 includes a respective handle bearing (e.g., bearing 152 of FIG. 2) for each end portion 302 of the bar. Each handle bearing 152 includes a respective hollowed cylindrical piece that includes an inner circumferential surface and an outer circumferential surface (e.g., an inner diameter and an outer diameter). In some embodiments, each handle bearing 152 is a bushing. In some embodiments, each handle bearing 152 is made of a non-metallic material such as Nylon, polytetrafluoroethylene (PTFE), or another plastic material. In some embodiments, each handle bearing 152 is made of metal (e.g., bronze). In some embodiments, each handle bearing 152 is made of metal of sintered or otherwise porous constitution. Furthermore, in some embodiments each handle bearing 152 is lubricated with mineral oil, or similar lubricant such as water displacement lubricant. In some embodiments each handle bearing 152 is made of any of the materials disclosed above for the center shaft 150 or handle tube 110. While the handle bearing 152 can be made of any of the materials disclosed above for the center shaft 150 or handle tube 110, there is no requirement that the handle bearing 152 be made of the same material as the center shaft 150 or handle tube 110.

In some embodiments, each end portion 302 of the center shaft 150 is fitted through the respective cylindrical piece of the handle bearing 152, with the exterior circumferential surface of the respective cylindrical piece of the handle bearing 152 contacting, in turn, the inner circumferential surface of center shaft 150 as illustrated, for example, in FIG. 3. In some embodiments, the handle bearing 152 includes a ball, needle, roller, or other bearing mechanism. Additionally, the longitudinal interior bore of the handle tube 110 encapsulates and makes frictional contact with the outer surface of each handle bearing 152 as illustrated in FIG. 3. This frictional contact with the handle bearings 152 allows for the handle tube 110 to rotate independent from the handle end cap 130 and the center shaft 150, which improves at least a range of motion and/or a number of exercises capable of being performed by the bar 100.

In some embodiments, the exercise bar 100 includes a respective outer washer 154 that is fitted onto a corresponding end portion of the center shaft 150. Accordingly, a first face of each outer washer 154 is juxtaposed against an end face of the corresponding cylindrical piece 154, and a second face of the outer washer is juxtaposed against a first face of the corresponding handle end cap 130.

Further, in some embodiments, each respective band arm 140 is fitted onto a respective end 302*a* of the center shaft 150 through attachment to the corresponding handle end cap 130. The details of such attachment, in accordance with some embodiments, is shown in FIGS. 4 and 5. In some embodiments, the attachment of each respective band arm 140 to the corresponding handle end cap 130 includes a press fit attachment, a dowel and pin attachment (e.g., a first pin and a second pin), and other similar attachment mechanism capable of supporting a significant load (e.g., such as 25 pounds (lbs), 100 lbs, 200 lbs, 500 lbs, 1000 lbs, 1500 lbs, etc.) during operation.

Referring to FIGS. 4 and 5, in some embodiments, each respective handle end cap 130 includes a second bore hole (e.g., bore hole 442 of FIG. 4) that is configured to accommodate a respective band arm 140. In some embodiments, the second bore hole 442 is orthogonal to the first bore hole 218 (e.g., normal to a portion of the cylindrical exterior face 216 and extending to the central axis of the first cylindrical handle end cap 130 as illustrated in FIG. 4). Accordingly, each respective band arm 140 is attached to the corresponding handle end cap by slotting a first end of the band arm 140 through the second bore hole 442 of the handle end cap.

In some embodiments, each respective end portion 302 of the center shaft 150 includes a notch (e.g., notch 502 of FIG. 5) that receives the first end of a respective band arm 140. For instance, the first end portion 302*a* of the center shaft 150 includes a first notch 502 that receives the first end portion of the first band arm 140, and the second end portion 302*b* of the center shaft 150 includes a second notch 502 that receives the first end portion of the second band arm 140. Preferably, the first notch 502 and the second notch 502 are disposed at a same side of the center shaft 150, which allows for each band arm 130 to be at a same level and/or orientation and provides an even distribution of resistance from the elastic bands 190 during operation of the exercise bar 100. Furthermore, the notch 502 allows for the respective band arm 140 to couple to the center shaft 150, allowing the center shaft to rotate within, and independent of, the handle tube 110.

In some embodiments, the exercise bar 100 includes a locking pin 134 for each respective end of the bar. In some embodiments, each handle end cap 130 includes a third bore hole (e.g., bore hole 222 of FIG. 4 and/or bore hole 136 of FIG. 1). In some embodiments, the third bore hole 222 is parallel to the first bore hole 218 between the first and second face of the respective handle end cap 130 while passing through, and orthogonal to, the second bore hole 442 of the handle end cap. Moreover, the first end of each band arm 140 includes a corresponding bore hole 242 that is configured to receive the locking pin 134 when the locking pin 134 is slotted through the third bore hole 136/222. Accordingly, each locking pin 134 locks the first end of the respective band arm 140 to the corresponding handle end cap 130 by insertion of the locking pin 134 through both the third bore hole 222 of the handle end cap 130 and the bore hole 242 of the first band arm. In some embodiments, the locking pin 134 does not interfere with a respective washer 154 (e.g., the washer 154 is free to rotate).

Furthermore, in some embodiments, referring to FIG. 2, the second end face 214 of each respective handle end cap 130 includes a removably coupled cover 132. In some embodiments, the cover 132 is coupled to the corresponding handle end cap 130 through the locking pin 134. In some embodiments, the cover 132 is coupled to the corresponding handle end cap 130 through a press-fit (e.g., snap) connection.

In some embodiments, the cover 132 includes each bore hole associated with the above described second end face 214. For instance, in some embodiments, the cover 132 includes respective bore holes 136, 222, 442, etc.

In some embodiments, the cover 132 secures the pin 134 through a hole in the cover (e.g., hole 222) while also, optionally, providing an aesthetic area to configure for a designer of the present disclosure. In some embodiments, the cover 132 includes a graphic or an artwork such as a corporate logo. In some embodiments, the cover 132 includes a soft material such as rubber, which prevents the exercise bar 100 from inadvertently damaging a surrounding environment and/or an end-user.

In some embodiments, the cover 132 does not include a bore hole associated with the above described second end face 214 (e.g., bore hole 134 and 136). In some embodiments, the third bore hole 222 penetrates the corresponding handle end cap 130 and the cover 132. In some embodiments, the third bore hole 222 penetrates the corresponding handle end cap 130 but not the cover 132. Further, in some embodiments, the cover 132 is removably coupled to the second end face 214 and includes an uninterrupted face (e.g., there is no hole through the cover 132). In some embodiments, the cover 132 is accommodated by the respective handle end cap 130 (e.g., the cover fits into an end portion of the handle end cap). Moreover, in some embodiments the respective handle end cap 130 is accommodated by the cover 132 (e.g., the handle end cap fits into an end portion of the cover).

Figure 6:
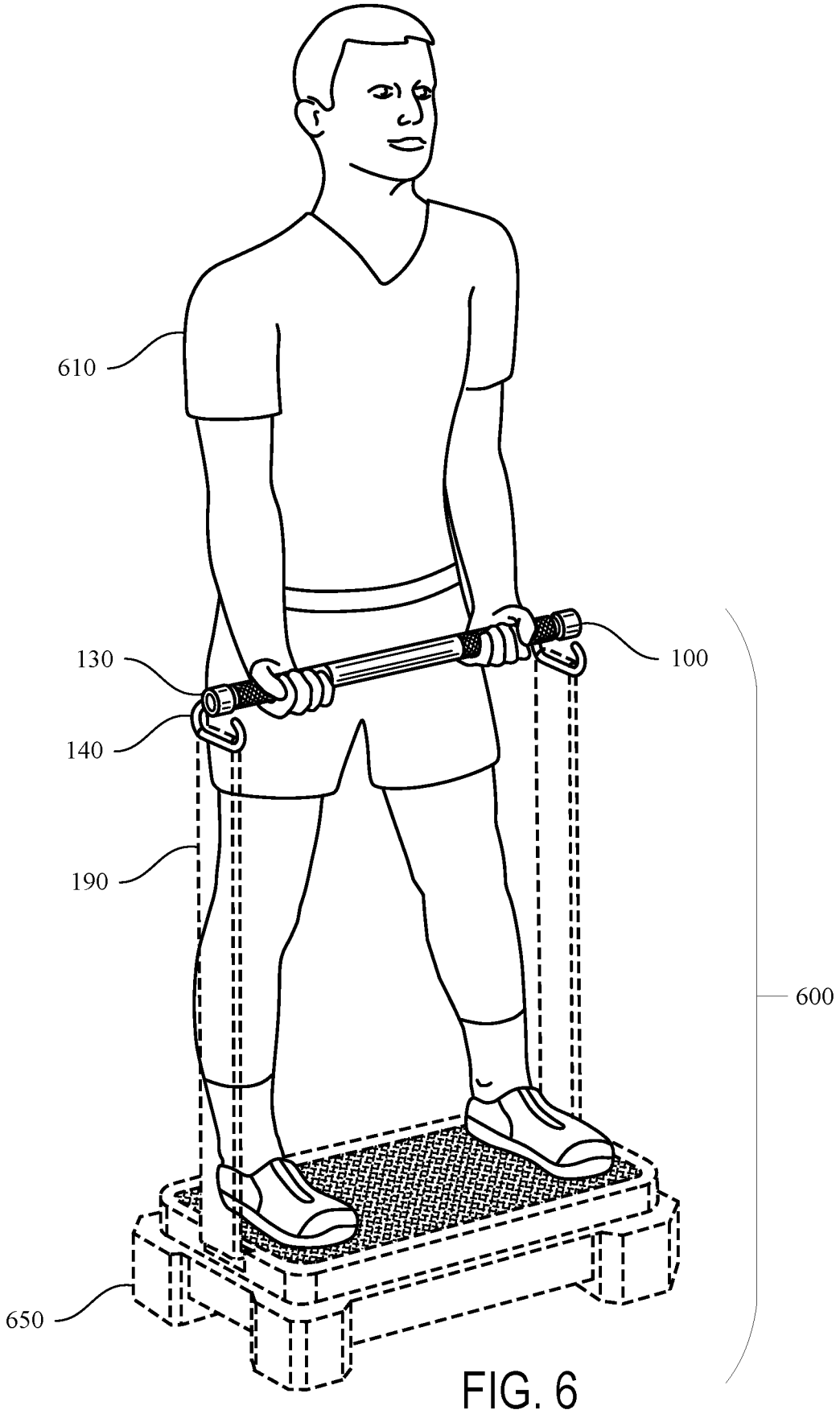
FIGS. 6 and 7 illustrate an end-user utilizing an exemplary exercise bar in a first position and a second position, respectively, in accordance with an embodiment of the present disclosure.
Figure 7:
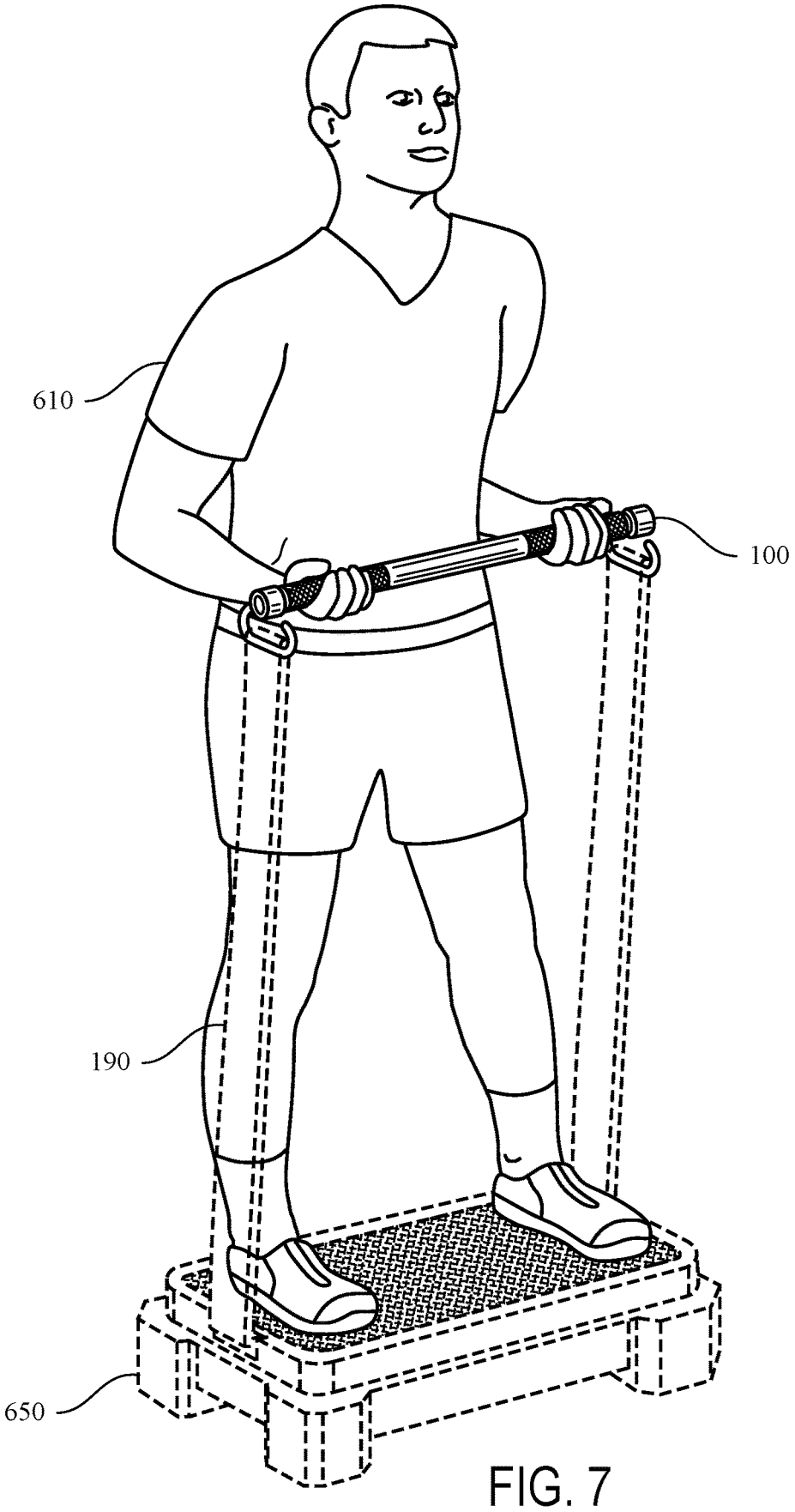

Referring to FIGS. 6 and 7, in some embodiments the present disclosure provides an exercise kit 600 for performing exercises. In the illustrated embodiments depicted in FIGS. 6 and 7, an end-user performs a curl from a first position (e.g., a first position depicted in FIG. 6) to a second position (e.g., a second position depicted in FIG. 7). In some embodiments, the exercise kit includes an exercise bar 100, a base 650, and one or more elastic bands 190 that couple the exercise bar to the base. In some embodiments, the base is made of CNC milled Marine Grade HDPE (high density polyethylene). In some embodiments, each elastic band 190 in the one or more elastic bands has a unique elasticity, or similarly maximum resistance. For instance, in some embodiments, the exercise kit 600 includes two elastic bands 190. The two elastic bands 190 include a first elastic band of a first maximum resistance (e.g., a low maximum resistance such as 5 lbs) and a second band of a second maximum resistance different than the first maximum resistance (e.g., a high resistance such as 100 lbs). In some embodiments, the exercise kit 600 includes at least three exercise bands 190. In some embodiments, the at least three exercise bands 190 of the exercise kit 600 include a first elastic band 190-1 characterized by a first maximum resistance, a second elastic band 190-2 characterized by a second maximum resistance that is greater than the first maximum resistance, and a third elastic band 190-3 having a third maximum resistance that is greater than the second maximum resistance. In some embodiments, a respective maximum resistance of each band 190 is determined, at least in part, by a width and/or thickness of the band (e.g., a lower resistance band includes a thinner width and/or thickness compared to a higher resistance band). For instance, in some embodiments the third band 190-3 has a width is about a same length as the level portion 144 of each band arm 140 (e.g., the width of the third band is of from about 75% to about 100% the length of the level portion of the band arm). In some embodiments, the second band 190-2 has a width is less than the length as the level portion 144 of each band arm 140 (e.g., the width of the second band is of from about 40% to about 75% the length of the level portion of the band arm). In some embodiments, the first band 190-1 has a width that is less than the length as the level portion 144 of each band arm 140 (e.g., the width of the first band is of from about 5% to about 40% the length of the level portion of the band arm). In some embodiments, the one or more elastic bands 190 of the present disclosure includes a band that is a continuous flat loop (e.g., a rehabilitation band and/or a fit loop band). In some embodiments, the one or more elastic bands 190 of the present disclosure includes a band that has a handle (e.g., an ankle cuff, a hard handle such as plastic, a soft handle such as foam, etc.). Accordingly, in some embodiments a user utilizes their body (e.g., feet, back, etc.) to perform an exercise without the base 650.

In some embodiments the elastic band 190 provides about 25 lbs of maximum resistance to an end user of the exercise bar 100. In some embodiments, the elastic band 190 provides about 50 lbs of maximum resistance to an end user of the exercise bar 100. In some embodiments, the elastic band 190 provides about 100 lbs of maximum resistance to an end user of the exercise bar 100. In some embodiments, the elastic band 190 provides about 150 lbs of maximum resistance to an end user of the exercise bar 100. In some embodiments, the elastic band 190 provides about 200 lbs of maximum resistance to an end user of the exercise bar 100. In some embodiments, the elastic band 190 provides about 250 lbs of maximum resistance to an end user of the exercise bar 100. In some embodiments, the elastic band 190 provides about 300 lbs of maximum resistance to an end user of the exercise bar 100. In some embodiments, the elastic band 190 provides about 350 lbs of maximum resistance to an end user of the exercise bar 100. In some embodiments, the elastic band 190 provides about 400 lbs of maximum resistance to an end user of the exercise bar 100. In some embodiments, the elastic band 190 provides about 500 lbs of maximum resistance to an end user of the exercise bar 100. In some embodiments, the elastic band 190 provides about 600 lbs of maximum resistance to an end user of the exercise bar 100.

In some embodiments the elastic band 190 provides between 20 lbs and 60 lbs of maximum resistance to an end user of the exercise bar 100. In some embodiments, the elastic band 190 provides between 25 lbs and 90 lbs of maximum resistance to an end user of the exercise bar 100. In some embodiments, the elastic band 190 provides between 75 lbs and 125 lbs of maximum resistance to an end user of the exercise bar 100. In some embodiments, the elastic band 190 provides between 110 lbs and 180 lbs of maximum resistance to an end user of the exercise bar 100. In some embodiments, the elastic band 190 provides between 175 lbs and 240 lbs of maximum resistance to an end user of the exercise bar 100. In some embodiments, the elastic band 190 provides between 230 lbs and 280 lbs of maximum resistance to an end user of the exercise bar 100. In some embodiments, the elastic band 190 provides between 275 lbs and 325 lbs of maximum resistance to an end user of the exercise bar 100. In some embodiments, the elastic band 190 provides between 325 lbs and 375 lbs of maximum resistance to an end user of the exercise bar 100. In some embodiments, the elastic band 190 provides between 350 lbs and 425 lbs of maximum resistance to an end user of the exercise bar 100. In some embodiments, the elastic band 190 provides between 400 lbs and 475 lbs of maximum resistance to an end user of the exercise bar 100. In some embodiments, the elastic band 190 provides between 450 lbs and 650 lbs of maximum resistance to an end user of the exercise bar 100. In some embodiments, the elastic band 190 provides between 650 lbs and 750 lbs of maximum resistance to an end user of the exercise bar 100.

In some embodiments the elastic band 190 provides between 10 kilograms and 30 kilograms of maximum resistance to an end user of the exercise bar 100. In some embodiments, the elastic band 190 provides between 13 kilograms and 45 kilograms of maximum resistance to an end user of the exercise bar 100. In some embodiments, the elastic band 190 provides between 35 kilograms and 63 kilograms of maximum resistance to an end user of the exercise bar 100. In some embodiments, the elastic band 190 provides between 55 kilograms and 90 kilograms of maximum resistance to an end user of the exercise bar 100. In some embodiments, the elastic band 190 provides between 80 kilograms and 120 kilograms of maximum resistance to an end user of the exercise bar 100. In some embodiments, the elastic band 190 provides between 130 kilograms and 140 kilograms of maximum resistance to an end user of the exercise bar 100. In some embodiments, the elastic band 190 provides between 125 kilograms and 180 kilograms of maximum resistance to an end user of the exercise bar 100. In some embodiments, the elastic band 190 provides between 160 kilograms and 180 kilograms of maximum resistance to an end user of the exercise bar 100. In some embodiments, the elastic band 190 provides between 160 kilograms and 210 kilograms of maximum resistance to an end user of the exercise bar 100. In some embodiments, the elastic band 190 provides between 200 kilograms and 240 kilograms of maximum resistance to an end user of the exercise bar 100. In some embodiments, the elastic band 190 provides between 225 kilograms and 325 kilograms of maximum resistance to an end user of the exercise bar 100. In some embodiments, the elastic band 190 provides between 325 kilograms and 325 kilograms of maximum resistance to an end user of the exercise bar 100.

In some embodiments each respective elastic band in the one or more elastic bands has a thickness of at least 1 cm and a length of between 180 centimeters and 220 centimeters when the respective elastic band is in an unextended state. In some embodiments each respective elastic band in the one or more elastic bands has a thickness of at least 1 cm, at least 1.5 cm, at least 2 cm, at least 2.5 cm, or at least 3.0 cm and a length of between 100 centimeters and 220 centimeters or between 100 centimeters and 280 centimeters when the respective elastic band is in an unextended state.

In some embodiments, the present disclosure provides a first band 190-1 that includes a thickness of about 5 mm, a width of about 0.8125 ins, a length of about 41 ins, and about a 100 lbs force production capacity. In some embodiments, the present disclosure provides a second band 190-2 that includes a thickness of about 5 mm, a width of about 1.125 ins, a length of about 41 ins, and about a 160 lbs force production capacity. In some embodiments, the present disclosure provides a third band 190-1 that includes a thickness of about 5 mm, a width of about 1.75 ins, a length of about 41 ins, and about a 240 lbs force production capacity. In some embodiments, the present disclosure provides a fourth band 190-1 that includes a thickness of about 5 mm, a width of about 2.5 ins, a length of about 41 ins, and about a 300 lbs force production capacity.

Advantageously, the disclosed exercise kit is a variable resistance device meaning that the further the elastic band 190 is extended by a user, the more resistance the device will exert. So, for instance, when the user extends a band a first distance beyond the relaxed state of the band 190, the band exerts a first resistance (e.g., 80 pounds). When the user extends the band beyond the first distance to a second distance beyond the first state, the band exerts a second resistance that is greater than the first resistance (e.g., 200 pounds). When the user extends the band beyond the second distance to a third distance beyond the first second distance, the band exerts a third resistance that is greater than the second resistance (e.g., 350 pounds), and so on until the user can no longer exert the band further or the maximum resistance of the band is achieved. In other words, the resistance (tension on the muscle) changes (varies) as the user performs an exercise. The resistance is less when the user starts to perform a repetition and it is most when the user is at the end of the repetition. This is advantageous because the exercise kit provides lower resistance at short exertion distances, where body joints are at risk, and higher resistance at longer exertion distances where improved body mechanics arise. The disclosed variable resistance exercised kit is different than free weights. Free weights, such as barbells and dumbbells, provide a constant resistance.

In some embodiments, the user performs an exercise in which the user initially exerts the exercise bar 100 across a full range of motion, for instance between (i) to the region in which the elastic band 190 exerts a high resistance (e.g., the third resistance described above) and (ii) the relaxed state in which the elastic band 190 exerts no or minimal resistance, a series of times until the user can no longer exert the exercise bar 100 across the full range of motion of the elastic band. Next, the user exerts the exercise bar 100 across an intermediate range of motion, for instance between (i) the region in which the elastic band 190 exerts less than the highest resistance (e.g. the second resistance described above) and (ii) the relaxed state in which the elastic band 190 exerts no or minimal resistance, a series of times until the user can no longer exert the exercise bar 100 across the intermediate range of motion. Next, in some embodiments of the exercise, the user exerts the exercise bar 100 across minimal range of motion, for instance between (i) the region in which the elastic band 190 exerts less than the intermediate resistance (e.g. the first resistance described above) and (ii) the relaxed state in which the elastic band 190 exerts no or minimal resistance, a series of times until the user can no longer exert the exercise bar 100 through the minimal range of motion. At the end of this, the user can no longer exert the exercise bar through any of the above ranges of motion until a later time, that is, the user has achieved absolute fatigue. In this way, through such diminishing ranges of motion, osteogenic stimulus is achieved. As such, a program in which such an exercise is done on a regular basis leads to increased muscle strength.

In some embodiments, the systems (e.g., exercise kit 600) and devices (e.g., exercise bar 100) of the present disclosure are utilized to perform one or more exercises such as a standing chest press, upright row, triceps pushdown, front squat, deadlift, bent over row, biceps curl, calf raise, and standing shoulder press. In some such embodiments such exercises are performed as described above, beginning with a full range of motion, and as fatigue sets in, with diminishing ranges of motion, under constant but variable resistance.

What is claimed is:

1. An exercise bar comprising:

a handle tube with a longitudinal interior bore, the handle tube having a first end and a second end;

a solid metal center shaft, wherein the solid metal center shaft is fitted through the longitudinal interior bore thereby exposing a first end portion of the solid metal center shaft at the first end of the handle tube and exposing a second end portion of the solid metal center shaft at the second end of the handle tube, and wherein the solid metal center shaft longitudinally rotates independent of the handle tube while coupled with the handle tube;

a first cylindrical handle end cap connected to the first end portion of the solid metal center shaft;

a second cylindrical handle end cap connected to the second end portion of the solid metal center shaft;

a first band arm locked with the first cylindrical handle end cap, the first band arm comprising a first end received by a first notch at the first end portion of the solid metal center shaft, and a first hook region that removably receives a first portion of an elastic band; and a second band arm locked with the second cylindrical handle end cap, the second band arm comprising a first end received by a second notch at the second end portion of the solid metal center shaft, and a second hook region that removably receives a second portion of the elastic band.

2. The exercise bar of claim 1, further comprising:

the first cylindrical handle end cap having a first end face, a second end face, and a cylindrical exterior face, with a first bore hole along a central axis of the first cylindrical handle end cap between the first and second end faces of the first cylindrical handle end cap; and the second cylindrical handle end cap having a first end face, a second end face, and a cylindrical exterior face, with a first bore hole along a central axis of the second cylindrical handle end cap between the first and second end faces of the second cylindrical handle end cap, wherein the first end portion of the solid metal center shaft is fitted through the first bore hole of the first cylindrical handle end cap, the second end portion of the solid metal center shaft is fitted through the first bore hole of the second cylindrical handle end cap, the first band arm is fitted onto the first end portion of the solid metal center shaft through attachment to the first cylindrical handle end cap, and the second band arm is fitted onto the second end portion of the solid metal center shaft through attachment to the second cylindrical handle end cap.

3. The exercise bar of claim 2, further comprising:

a first handle bearing comprising a first hollowed cylindrical piece having an inner circumferential surface and an outer circumferential surface; and a second handle bearing comprising a second hollowed cylindrical piece having an inner circumferential surface and an outer circumferential surface, wherein the first end portion of the solid metal center shaft is fitted through the first handle bearing with the solid metal center shaft contacting the inner circumferential surface of the first handle bearing, the second end portion of the solid metal center shaft is fitted through the second handle bearing with the solid metal center shaft contacting the inner circumferential surface of the second handle bearing, and the longitudinal interior bore of the handle tube encapsulates and makes frictional contact with the outer circumferential surface of both the first and second handle bearings.

4. The exercise bar of claim 3, further comprising:

a first outer washer fitted onto the first end portion of the solid metal center shaft; and second outer washer fitted onto the second end portion of the solid metal center shaft, wherein a first face of the first outer washer is juxtaposed against an end face of the first hollowed metal cylindrical piece of the first handle bearing, a second face of the first outer washer, which opposes the first face of the first outer washer, is juxtaposed against the first end face of the first cylindrical handle end cap, a first face of the second outer washer is juxtaposed against an end face of the second hollowed metal cylindrical piece of the second handle bearing, and a second face of the second outer washer, which opposes the first face of the second outer washer, is juxtaposed against the first end face of the second cylindrical handle end cap.

5. The exercise bar of claim 2, wherein the first cylindrical handle end cap has a second bore hole, orthogonal to the first bore hole of the first cylindrical handle end cap, the second bore hole of the first cylindrical handle end cap runs between the cylindrical exterior face and the central axis of the first cylindrical handle end cap, the second cylindrical handle end cap has a second bore hole, orthogonal to the first bore hole of the second cylindrical handle end cap, the second bore hole of the second cylindrical handle end cap runs between the cylindrical exterior face and the central axis of the second cylindrical handle end cap, the first band arm is attached to the first cylindrical handle end cap by slotting the first end of the first band arm through the second bore hole of the first cylindrical handle end cap, and the second band arm is attached to the second cylindrical handle end cap by slotting the first end of the second band arm through the second bore hole of the second cylindrical handle end cap.

6. The exercise bar of claim 5, further comprising a first locking pin and a second locking pin, wherein the first cylindrical handle end cap further comprises a third bore hole running between the first and second end faces of the first cylindrical handle end cap, parallel to the first bore hole of the first cylindrical handle end cap, and passing through the second bore hole of the first cylindrical handle end cap, the second cylindrical handle end cap further comprises a third bore hole running between the first and second end faces of the second cylindrical handle end cap, parallel to the first bore hole of the second cylindrical handle end cap, and passing through the second bore hole of the second cylindrical handle end cap, the first end of the first band arm includes a bore hole, the first end of the second band arm includes a bore hole, the first locking pin locks the first end of the first band arm to the first cylindrical handle end cap by insertion through both the third bore hole of the first cylindrical handle end cap and the bore hole of the first end of the first band arm, and the second locking pin locks the first end of the second band arm to the second cylindrical handle end cap by insertion through both the third bore hole of the second cylindrical handle end cap and the bore hole of the first end of the second band arm.

7. The exercise bar of claim 5, further comprising a first locking pin and a second locking pin, wherein:

the first cylindrical handle end cap further comprises a third bore hole running between the first and second end faces of the first cylindrical handle end cap, parallel to the first bore hole of the first cylindrical handle end cap, and passing through the second bore hole of the first cylindrical handle end cap, the second cylindrical handle end cap further comprises a third bore hole running between the first and second end faces of the second cylindrical handle end cap, parallel to the first bore hole of the second cylindrical handle end cap, and passing through the second bore hole of the second cylindrical handle end cap, the first end of the first band arm includes a bore hole, the first end of the second band arm includes a bore hole, the first locking pin locks the first end of the first band arm to the first cylindrical handle end cap by insertion through both the third bore hole of the first cylindrical handle end cap and the bore hole of the first end of the first band arm, and the second locking pin locks the first end of the second band arm to the second cylindrical handle end cap by insertion through both the third bore hole of the second cylindrical handle end cap and the bore hole of the first end of the second band arm.

8. The exercise bar of claim 1, wherein the handle tube includes a first circumferential grip region and a second circumferential grip region on an exterior circumferential surface of the handle tube.

9. The exercise bar of claim 8, wherein the first circumferential grip region is a level surface, and the second circumferential grip region is characterized by a pattern of straight, angled, crossed lines, or a combination thereof.

10. The exercise bar of claim 9, wherein the second circumferential grip region is disposed at both the first end and the second end of the handle tube, and the first circumferential grip region is disposed between the first end and the second end of the handle tube.

11. The exercise bar of claim 1, wherein the first band arm is made of metal and the second band arm is made of metal.

12. The exercise bar of claim 11, wherein a third portion of the elastic band is received by a portion of a base, thereby coupling the exercise bar to the base through the elastic band.

13. The exercise bar of claim 1, wherein the solid metal center shaft or the handle tube is made of austenite steel, martensitic steel, ferritic steel, a nickel alloy, or a high-strength low-alloy steel.

14. The exercise bar of claim 13, wherein the solid metal center shaft is made of a different metal material than that of the handle tube.

15. An exercise kit comprising:

the exercise bar of claim 1;

a base having a bottom face, wherein the bottom face includes a groove; and one or more elastic bands, wherein each respective elastic band in the one or more elastic bands is configured to removably couple the base to the exercise bar by fitting the respective elastic band into the groove of the base and through the first and second band arms.

16. The exercise kit of claim 15, wherein a first elastic band in the one or more elastic bands has a thickness of at least 1 centimeter and a length of between 100 centimeters and 220 centimeters when the first elastic band is in an unextended state.

17. The exercise bar of claim 1, wherein the first notch and the second notch are disposed at a first side of the center shaft.

18. The exercise bar of claim 1, wherein the solid metal center shaft is made of a metal or metal alloy.

19. The exercise bar of claim 1, wherein the handle tube is between 40 centimeters and 80 centimeters in length, and the handle tube has a diameter of between 3 centimeters and 5 centimeters.

20. The exercise bar of claim 1, wherein the first hook region comprises an open form shape comprising a gap configured to receive the elastic band.

* * * * *